United States Patent [19]

Heberle et al.

[11] Patent Number: 4,617,903

[45] Date of Patent: Oct. 21, 1986

[54] DIESEL ENGINE WITH INJECTION PUMP COORDINATED TO EACH CYLINDER

[75] Inventors: Hans-Jörg Heberle, Bodman-Ludwigshafen; Wolfgang Rudert, Langenargen, both of Fed. Rep. of Germany

[73] Assignee: MTU Motoren und Turbinen-Union Friedrichshafen GmbH, Fed. Rep. of Germany

[21] Appl. No.: 700,178

[22] Filed: Feb. 11, 1985

[30] Foreign Application Priority Data

Jul. 11, 1984 [DE] Fed. Rep. of Germany ..... 3425522

[51] Int. Cl.[4] ..... F02M 59/20

[52] U.S. Cl. ..... 123/501; 123/502

[58] Field of Search ..... 123/501, 502, 495, 508, 123/90.16

[56] References Cited

U.S. PATENT DOCUMENTS 2,663,288 12/1953 Hutchison ..... 123/90.16
2,863,438 12/1958 Challis ..... 123/502
3,112,739 12/1963 Peras ..... 123/90.16
4,476,836 10/1984 Enomoto et al. ..... 123/501

FOREIGN PATENT DOCUMENTS 126459 7/1983 Japan ..... 123/501
60405 1/1939 Norway ..... 123/501

*Primary Examiner*—Magdalen Y. C. Greenlief
*Attorney, Agent, or Firm*—Craig & Burns

[57] ABSTRACT

A diesel engine with an injection pump coordinated to each cylinder. The pump piston (13) of each injection pump is actuated by a cam (15) of a camshaft (12) by way of a roller tappet (14). Each roller tappet (14) is arranged in an individual tappet guide member (16) which is axially adjustably supported by means of two coaxial cylindrical guide pins (17, 18) in corresponding openings (19, 20) of the cylinder crankcase (11). By means of this arrangement, the position between cam (15) and roller tappet (14) and therewith the delivery start of the injection pump is adjustable by displacement of the tappet guide member (16). A universal applicability for diesel engines with different cylinder numbers is achieved by the individual arrangement of the tappet guide members (16), whereby additionally a simple manufacture and assembly is realized. The displacement of the tappet guide member (16) takes place by a control shaft (21) which is operatively connected with several coordinated tappet guide members (16) by means of eccentrics (22), whereby the rotary movement of the control shaft (21) is initiated by a lever (23) from a stroke-controlled power source.

21 Claims, 6 Drawing Figures

DIESEL ENGINE WITH INJECTION PUMP COORDINATED TO EACH CYLINDER

The present invention relates to a diesel engine with an injection pump coordinated to each cylinder, whose pump pistons can be actuated by cams by way of roller tappets which are arranged in a tappet guide member displaceably constructed transversely to the axis of the cams. The delivery start of the injection pumps can be varied with such an arrangement during the operation. The adjusting mechanism thereby cooperates with a control mechanism dependent on operating parameters of the diesel engine, whereby the start of the delivery of the injection pumps is automatically matched to the respective operating conditions.

An injection pump of the aforementioned type for a diesel engine is disclosed in the AT-PS No. 189,447. The roller tappets of all pump pistons are arranged in this prior art injection pump in a common rigid tappet guide member. In the application of the prior art arrangement to production series of different diesel engines, different tappet guide members are required corresponding to the different number of cylinders of a respective diesel engine model. An uneconomical manufacture and stocking of parts result therefrom. Furthermore, the bearing support of a tappet guide member common to several pump pistons which is satisfactory from a load and stress point of view, is difficult and the adjusting mechanism complicated. The applicability of the known type of construction is additionally limited to diesel engines whose camshafts still exhibit load-free angular ranges between the pressure strokes of the pump pistons by reason of the number of the cylinder respective pump elements. As soon as the delivery periods of the injection pumps overlap, a suddenly increased adjusting force has to be produced for the displacement of the tappet guide member compared to the angular ranges of the camshaft not loaded by the pressure stroke. The mechanism necessary for producing such a high adjusting force requires a large structural expenditure which renders the realization uneconomical.

It is therefore the principal object of the present invention to provide for a diesel engine an adjustment of the start of the pump delivery by changing the engaging point between tappet roller and cam, which combines a universal applicability for diesel engines having different numbers of cylinders with simple manufacture and assembly.

The underlying problems are solved according to the present invention in that each roller tappet is arranged in an individual tappet guide member, in that each tappet guide member includes two coaxial guide pins, in that the guide pins are axially adjustably supported in corresponding openings of the surrounding housing and in that the common axis of the guide pins of each tappet guide member is arranged at right angle to the axis of rotation of the cams. An operationally reliable bearing support combined with ease of operation and simple manufacturing ability of the tappet guide members is achieved with this arrangement as also a construction of the housing correct from a manufacturing point of view. The stocking of tappet guide members is thus dependent only on the planned total number of cylinders whereby also greater economy is attained.

Further features of the present invention which will be described more fully hereinafter, make it possible to obtain a temporary decoupling between the adjustment command and the adjustment execution for the tappet guide members during the adjustment of the pump delivery start. The displacement of a tappet guide member takes place in each case in the first load-free instant after initiation of the adjusting command. The required adjusting forces remain thereby low also with overlapping delivery periods of the injection pumps. An initiated delivery start adjustment is terminated as soon as all pump pistons coordinated to a camshaft have passed through the injection sequence.

The advantages achieved with the present invention consist in particular in that an oil film, respectively, oil cushion is formed about the guide pins in the corresponding openings and in the closed hollow spaces, end-face of the guide pins, whereby vibrations are damped and a wear is prevented, in that the tappet guide members rotatable about the guide pin axis permit an automatic adjustment of the tappet rollers to the unavoidable bending of the camshaft, as a result of which the edge contact between tappet roller and cam which is dangerous from an operating point of view is avoided.

These and other objects, features and advantages of the prevent invention will become more apparent from the following description when taken in connection with the accompanying drawing which shows, for purposes of illustration only, several embodiments in accordance with the present invention, and wherein.

Referring now to the drawing wherein like reference numerals are used throughout the various views to designate like parts, the following description applies equally to all three embodiments of the present invention.

Figure 1:
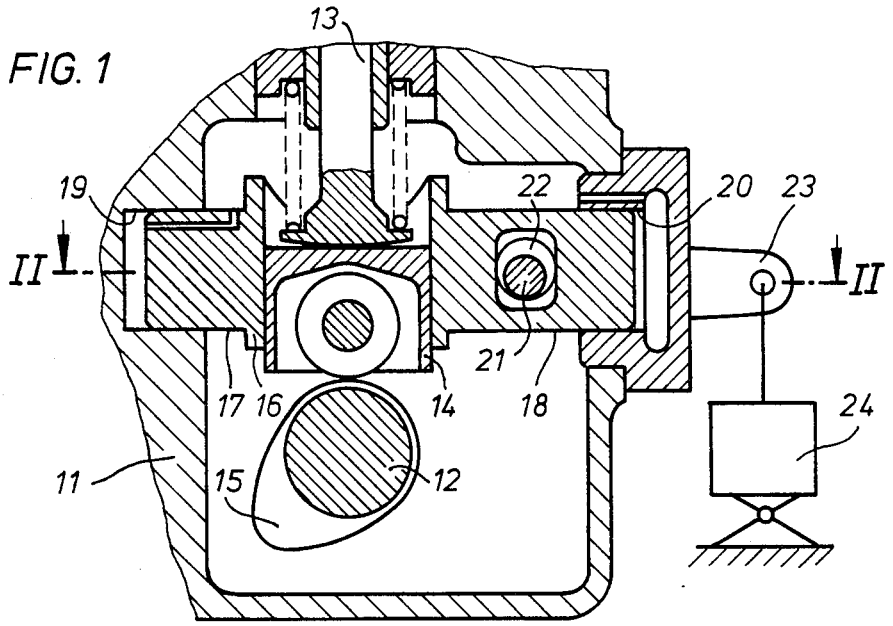
FIG. 1 is a partial cross-sectional view through a diesel engine within the area of a pump piston with individual tappet guide member and a mechanical adjusting mechanism in accordance with the present invention, taken along line I—I of FIG. 2.

A cylinder crankcase 11 of a diesel engine, not illustrated in detail, contains a camshaft 12 with cams 15 and, for each cylinder, an injection pump with pump piston 13 and roller tappet 14. The stroke actuation of the pump pistons 13 takes place by cooperation of the cams 15 and roller tappets 14. Each roller tappet 14 is slidably supported in an individual tappet guide member 16 which is constructed displaceable transversely to the axis of rotation of the cams 15. A displacement of the tappet guide member 16 in the direction of rotation of the cam thereby effects a later start of pump delivery and a displacement opposite the direction of rotation of the cam an earlier start of pump delivery of the injection pumps.

Each tappet guide member 16 includes two cylindrical coaxial guide pins 17 and 18 which are supported in corresponding openings 19 and 20 in the cylinder-crankcase 11, whereby the common axis of the guide pins 17 and 18 is arranged at right angle to the camshaft 12. End-face of the guide pins 17 and 18, the openings 19 and 20 are constructed as closed hollow spaces which during the displacement of the tappet guide member 16 exert together with the oil film on the cylindrical slide surfaces of the guide pins that forms during the operation, a damping action on oscillations of the tappet guide member 16.

The cylindrical guide pins 17 and 18 permit a rotation of each tappet guide member 16 about the common axis through at least small angles. Each of the tappet rollers 14 in contact with a cam 15 can thus adjust itself to the unavoidable continuously varying bending of the camshaft 12. The dangerous edge contact betweet tappet roller 14 and cam 15 is eliminated therewith so that a higher surface load and stress is permitted and the life expectancy for the cam-tappet roller-repairing is increased.

Figure 2:
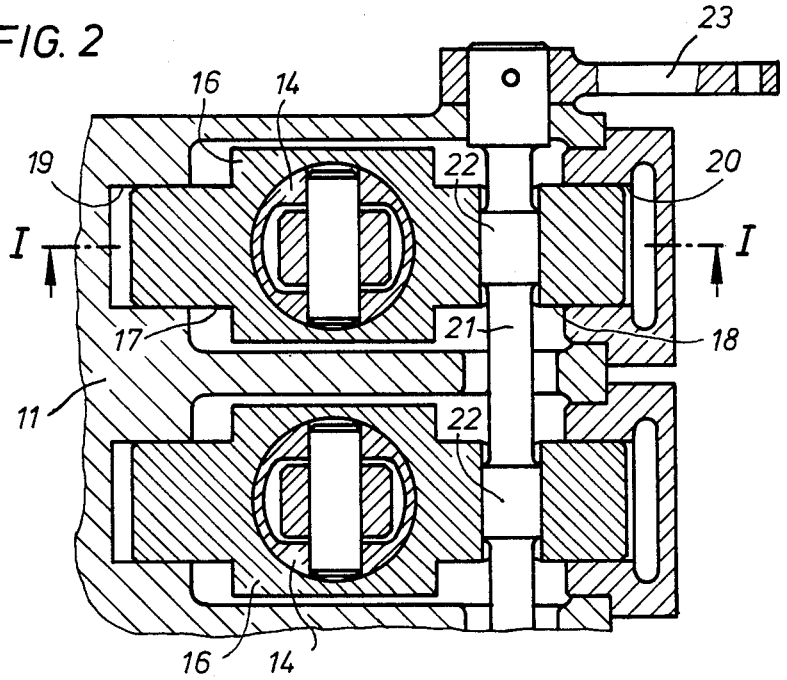
FIG. 2 is a partial longitudinal cross-sectional view through a diesel engine taken along line II—II of FIG. 1.

In the embodiment according to FIGS. 1 and 2, the adjustment of the tappet guide members 16 takes place by a control shaft 21 which is operatively connected by way of eccentrics 22 with the tappet guide members 16. The control shaft 21 is rotatable by means of a lever 23, whereby the eccentrics 22 bring about a displacement of the tappet guide members 16. The lever 23 is connected with a power source 24 which may be constructed, for example, as hydraulic servo motor with feedback control.

Figure 3:
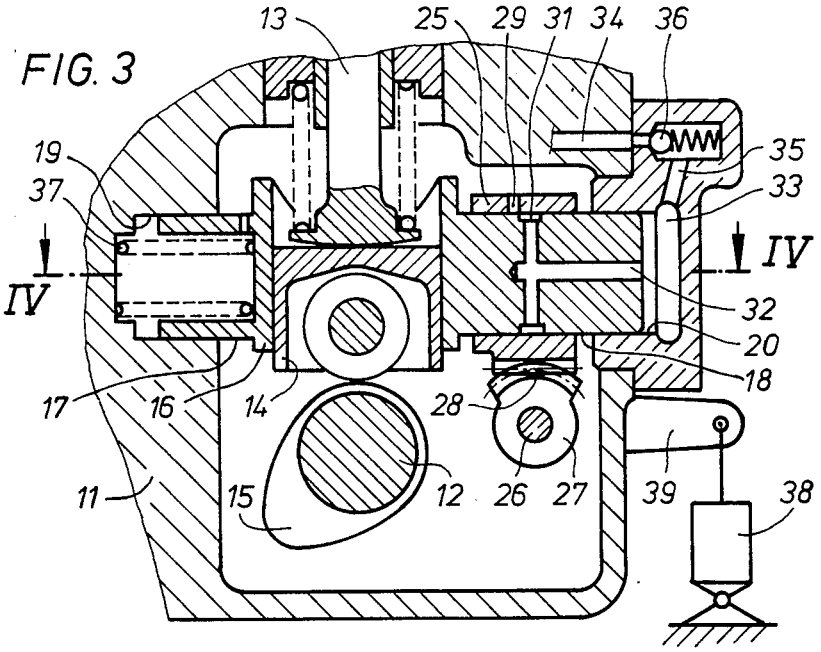
FIG. 3 is a partial cross-sectional view through a diesel engine within the area of a pump piston with individual tappet guide members and a hydromechanical adjusting mechanism in accordance with the present invention, taken along line III—III of FIG. 4.
Figure 4:
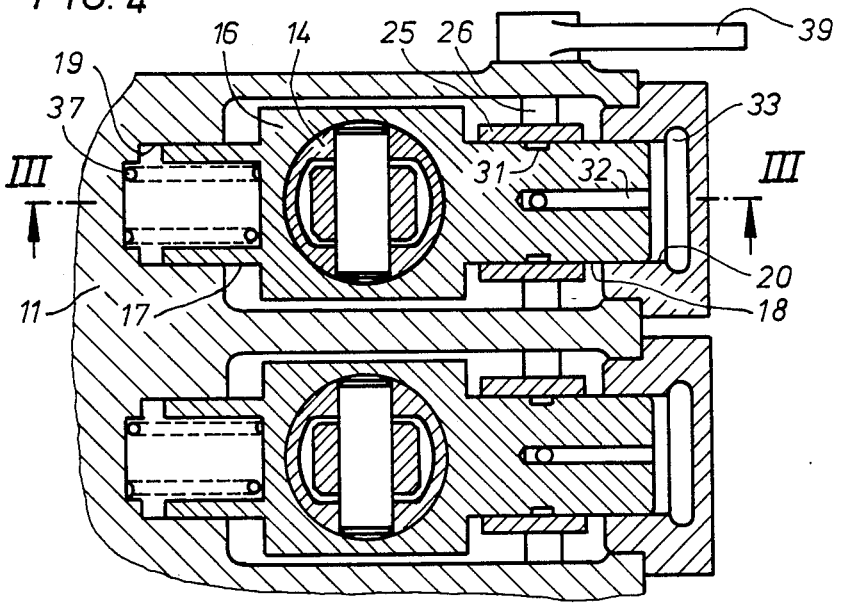
FIG. 4 is a partial longitudinal cross-sectional view of a diesel engine taken along line IV—IV of FIG. 3.

In the second embodiment illustrated in FIGS. 3 and 4, a control sleeve 25 is arranged on the guide pin 18 which is operatively connected with a control shaft 26 by way of an entrainment member 27. The operative connection may consist, for example, of a toothed engagement 28. The control sleeve 25 includes a cross bore 29. The guide pin 18 includes along its outer diameter an annular groove 31 forming a control edge which is connected by way of at least one bore 32 with the hollow space 33 at the end face of the guide pin 18. The hollow space 33 is fed with pressure oil from the lubricating oil circulation of the diesel engine by way of lines 34 and 35 and check valve 36. The other guide pin 17 of the tappet guide member 16 is constructed hollow and contains a spring 37 supported against the cylinder crankcase 11.

The position of cross bore 29 of the control sleeve 25 and of the annular groove 31 of the guide pin 18 illustrated in FIGS. 3 and 4, represents a state of rest for the position of the tappet guide member 16. The force of the spring 37 and of the oil pressure acting on the end-face of the guide pin 18 are thereby in equilibrium. A displacement of the control sleeve 25 toward the right effects a pressure relief of the space 33 by way of bore 32, annular groove 31 and cross bore 29. An excess of force of the spring 37 results therefrom which in turn results in a displacement of the tappet guide member 16 toward the right. With a displacement of the control sleeve 25 toward the left, the discharge of the space 33 is closed up so that a larger oil pressure can build up therein. A displacement of the tappet guide member 16 toward the left results therefrom until equilibrium is again established between spring 37 and oil pressure in space 33.

The displacement of the tappet guide member 16 takes place after initiation of an adjusting movement by way of the control shaft 26 in each case in the unloaded condition after the termination of a pressure stroke of the respectively coordinated pump piston 13.

The displacement of the control sleeve 25 on the guide pin 18 is practically free of reactive effect. Consequently, only a small adjusting force has to be produced by the adjusting mechanism 38 for the rotation of the control shaft 26 by means of lever 39.

Figure 5:
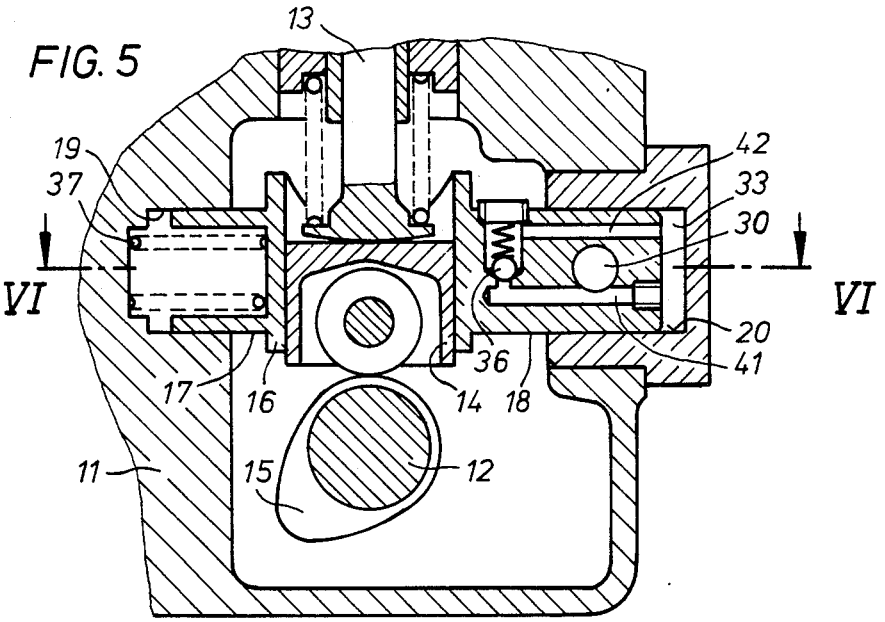
FIG. 5 is a cross-sectional view through a diesel engine within the area of a pump piston with individual tappet guide members and a hydraulic adjusting mechanism in accordance with the present invention, taken along line V—V of FIG. 6.
Figure 6:
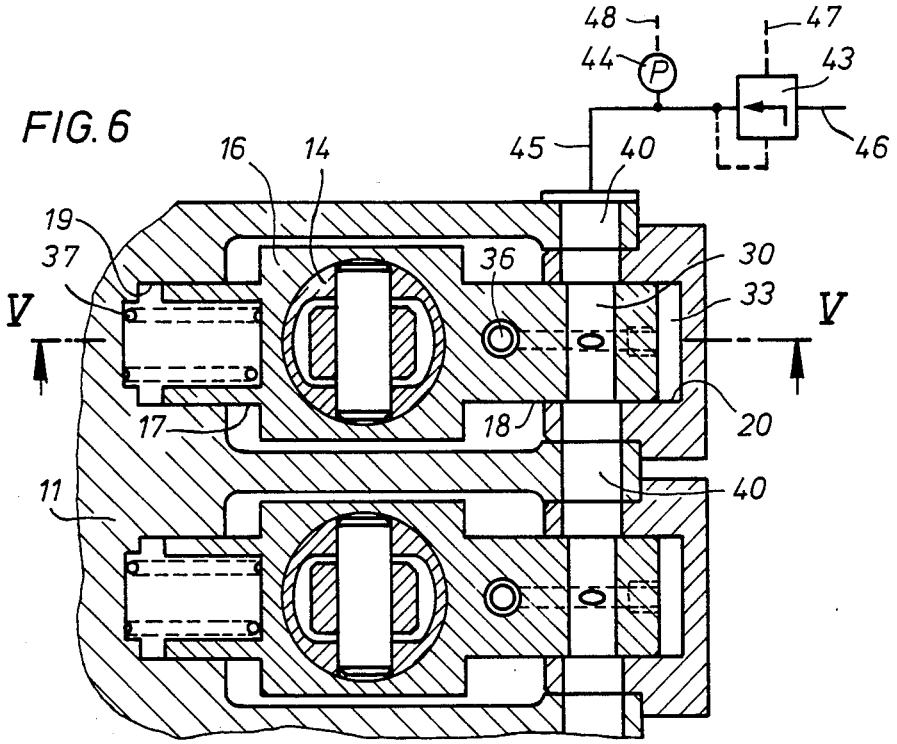
FIG. 6 is a partial longitudinal cross-sectional view through a diesel engine taken along line VI—VI of FIG. 5

In the third embodiment according to FIGS. 5 and 6, the adjustment of the tappet guide member 16 takes place as in the second embodiment by oil pressure which acts in the hollow space 33 on the end-face of the guide pin 18. In the rest position of the tappet guide member 16, the oil pressure exerted on the end-face of the guide pin 18 is in equilibrium with the force of the spring 37 which is supported against the end-face of the guide pin 17 and the cylinder crankcase 11.

A pressure oil line 40 in the form of a bore is arranged in the cylinder crankcase 11 parallel to the camshaft 15. All guide pins 18 of the coordinated tappet guide member 16 include a cross bore 30 which is in permanent connection with the pressure oil line 40. The cross bore 30 is connected with the hollow space 33 by way of bore 41, check valve 36 and bore 42.

The pressure oil line 40 is supplied with pressure oil from an oil feed line 46, for example, from the lubricating oil system of the diesel engine under interconnection of a pressure regulating valve 43 and a line 45. The pressure regulating valve 43 is remotely controlled by a control arrangement not illustrated in detail by way of a signal line 47. The actual-value of the oil pressure in the line connection 45-40-30-41 is determined by means of a pressure monitor 44 and is indicated to the control arrangement by way of the signal line 48.

A certain oil pressure in the hollow space 33 is coordinated to each position of the tappet guide member 16 corresponding to the characteristics of the spring 37. The oil pressure necessary for a desired position is maintained by the pressure regulating valve 43 in the line connection 45-40-30-41. For a displacement of the tappet guide member 16 toward the left, the oil pressure in the line connection 45-40-30-41 is increased, as a result of which the check valve 36 opens so that oil in the hollow space 33 can be resupplied. The tappet guide member 16 is displaced owing to the higher oil pressure in the hollow space 33 against the spring 37 for such length of time until equilibrium of the forces is again reached. For a displacement toward the right, the oil pressure in the line connection 45-40-30-41 is lowered so that the check valve 36 remains closed. As a result of oil loss from the hollow space 33 by way of the fitting joint or gap between guide pins 18 and opening 20, the oil pressure in the hollow space 33 drops. The force of the spring 37 is thereby capable to displace the tappet guide member 16 toward the right until equilibrium of the forces is again reached. The oil which sprays off continuously during operation out of hollow space 33 by way of the fitting joints or gaps between guide pins 18 and opening 20, effects an intensive lubrication of all slide surfaces within the area of the respective tappet guide member 16. By a brief opening of the check valve 36, the oil losses are compensated out of the line connection 45-40-30-41.

The application of the present invention is not limited to the arrangement with individual injection pumps according to the three embodiments but is equally applicable advantageously with so-called in-line injection pumps.

While we have shown and described only one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. A diesel engine, comprising an injection pump means coordinated to each cylinder, each injection pump means including a pump piston operable to be actuated by a cam by way of a roller tappet means, the roller tappet means being arranged in a tappet guide means, and adjusting means for displacing the tappet guide means in a plane which is substantially transverse to both the axis of rotation of the cam means and the longitudinal axis of the pump piston, each roller tappet means being arranged in an individual tappet guide means, each tappet guide means including two guide pins, the guide pins being axially displaceably supported in corresponding openings of a surrounding housing means, and the common axis of the guide pins being arranged substantially at right angle to the axis of rotation of the cam means.

2. A diesel engine according to claim 1, wherein each tappet guide means is rotatable through at least a small angle about the common axis of the guide pins.

3. A diesel engine according to claim 1, wherein said openings are constructed as closed hollow spaces at the end-faces of the guide pins.

4. A diesel engine according to claim 1, wherein the adjusting means includes at least one stroke-controlled power source means cooperating with the guide pins.

5. A diesel engine according to claim 4, wherein said adjusting means includes a control shaft rotatable by the power source means by way of a lever, said control shaft being operatively connected with the coordinated tappet guide means by way of eccentrics.

6. A diesel engine according to claim 4, wherein a stroke-controlled power source means is coordinated to each individual tappet guide means.

7. A diesel engine according to claim 6, wherein the end-face of one guide pin in each tappet guide means is constructed as power-source piston surface acted upon by oil pressure, and wherein a compression spring is arranged between the end-face of the other guide pin and the housing means.

8. A diesel engine according to claim 7, further comprising a control sleeve slidably arranged on the guide pin constructed as pressure-source piston.

9. A diesel engine according to claim 8, further comprising a control shaft which is operatively connected with each control sleeve of the coordinated tappet guide means.

10. A diesel engine according to claim 7, wherein a pressure oil line is arranged in the housing means which is operatively connected with a cross bore provided in the respective guide pin of the coordinated tappet guide means.

11. A diesel engine according to claim 10, wherein a check valve is arranged in each guide pin between the cross bore and the hollow space.

12. A diesel engine according to claim 11, further comprising a pressure regulating means which controls the pressure oil line.

13. A diesel engine according to claim 10, further comprising a pressure regulating means which controls the pressure oil line.

14. A diesel engine according to claim 1, wherein the end-face of one guide pin in each tappet guide means is constructed as power-source piston surface acted upon by oil pressure, and wherein a compression spring is arranged between the end-face of the other guide pin and the housing means.

15. A diesel engine according to claim 14, further comprising a control sleeve slidably arranged on the guide pin constructed as pressure-source piston.

16. A diesel engine according to claim 15, further comprising a control shaft which is operatively connected with each control sleeve of the coordinated tappet guide means.

17. A diesel engine according to claim 14, wherein a pressure oil line is arranged in the housing means which is operatively connected with a cross bore provided in the respective guide pin of the coordinated tappet guide means.

18. A diesel engine according to claim 17, wherein a check valve is arranged in each guide pin between the cross bore and the hollow space.

19. A diesel engine according to claim 17, further comprising a pressure regulating means which controls the pressure oil line.

20. A diesel engine according to claim 4, wherein said openings are constructed as closed hollow spaces at the end-faces of the guide pins.

21. A diesel engine according to claim 20, wherein each tappet guide means is rotatable through at least a small angle about the common axis of the guide pins.

* * * * *